US009189986B2

(12) United States Patent
Sasaki

(10) Patent No.: US 9,189,986 B2
(45) Date of Patent: Nov. 17, 2015

(54) DISPLAY PANEL DRIVING METHOD, DISPLAY DEVICE DRIVING CIRCUIT, AND DISPLAY DEVICE

(75) Inventor: Takashi Sasaki, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 566 days.

(21) Appl. No.: 13/635,751

(22) PCT Filed: Feb. 9, 2011

(86) PCT No.: PCT/JP2011/052728

§ 371 (c)(1),
(2), (4) Date: Sep. 18, 2012

(87) PCT Pub. No.: WO2011/118275

PCT Pub. Date: Sep. 29, 2011

(65) Prior Publication Data

US 2013/0010016 A1 Jan. 10, 2013

(30) Foreign Application Priority Data

Mar. 24, 2010 (JP) ..... 2010-067934

(51) Int. Cl.
*G09G 3/36* (2006.01)
*G09G 3/20* (2006.01)

(52) U.S. Cl.
CPC ..... *G09G 3/20* (2013.01); *G09G 2320/0233* (2013.01); *G09G 2320/048* (2013.01); *G09G 2320/0686* (2013.01); *G09G 2320/0693* (2013.01); *G09G 2360/145* (2013.01)

(58) Field of Classification Search
CPC ..... G09G 2320/048; G09G 2320/0693; G09G 2320/0686; G09G 2360/145; G09G 2320/0233; G09G 3/20
See application file for complete search history.

(56) References Cited

U.S. PATENT DOCUMENTS

| | | | | |
|---|---|---|---|---|
| 7,324,749 | B2 * | 1/2008 | Kubo | 396/429 |
| 8,547,311 | B2 * | 10/2013 | Chen et al. | 345/87 |
| 2005/0093798 | A1 * | 5/2005 | Kamada et al. | 345/89 |
| 2005/0280615 | A1 | 12/2005 | Cok et al. | |
| 2006/0012606 | A1 | 1/2006 | Hiraki et al. | |
| 2007/0052661 | A1 | 3/2007 | Shikata | |
| 2009/0030227 | A1 | 1/2009 | Okoshi et al. | |
| 2009/0303227 | A1 | 12/2009 | Hwang | |

FOREIGN PATENT DOCUMENTS

| | | | |
|---|---|---|---|
| JP | 2006030362 | A | 2/2006 |
| JP | 2007065572 | A | 3/2007 |
| JP | 2007094338 | A | 4/2007 |
| JP | 2008503775 | A | 2/2008 |
| JP | 2009294636 | A | 12/2009 |

OTHER PUBLICATIONS

International Search Report for PCT/JP2011/052728, dated Mar. 8, 2011.

* cited by examiner

*Primary Examiner* — Abbas Abdulselam
(74) *Attorney, Agent, or Firm* — Hauptman Ham, LLP

(57) ABSTRACT

A method of driving a display panel having a display area including different first and second display areas includes: (1) supplying image data to each of the first and second display area by a supply circuit to display an image therein; and (2) performing a first correction to correct only the image data supplied to the first display area in the image data supplying step. The first correction is performed based on a first correction data stored in a first memory.

18 Claims, 7 Drawing Sheets

DISPLAY PANEL DRIVING METHOD, DISPLAY DEVICE DRIVING CIRCUIT, AND DISPLAY DEVICE

RELATED APPLICATIONS

The present application is a National Phase of International Application Number PCT/JP2011/052728, filed Feb. 9, 2011, and claims priority from Japanese Application Number 2010-067934, filed Mar. 24, 2010.

TECHNICAL FIELD

The present invention relates to a method of driving a display panel, a display device driving circuit, and a display device, in particular to a technology that drives a display panel by supplying an image data to each of display areas of the display panel included in the display device.

BACKGROUND ART

In recent years, high-performance display devices such as a large screen television have become widely used. An image quality of the display devices is highly affected by uneven brightness and uneven color in a displayed image (hereinafter, the uneven brightness and the uneven color may be collectively referred to as "unevenness"), and thus correction of unevenness is required.

Patent Document 1 discloses a technology for correcting unevenness. According to this technology, a correction unit includes a memory. The memory stores a plurality of correction data each of which corresponds to each of display elements included in a display panel. When the correction unit corrects an image data, the correction data corresponding to each of the display elements stored in the memory is used to correct the image data supplied to each of the display elements. According to the technology in Patent Document 1 , the memory stores the correction data common to the display elements included in a predetermined area. This reduces a capacity of the memory compared to a memory storing a plurality of correction data each of which corresponds to each of the display elements.

RELATED ART DOCUMENT

Patent Document

Patent Document 1: Japanese Unexamined Patent Publication No. 2007-94338

Problem to be Solved by the Invention

However, the technology disclosed in Patent Document 1 cannot properly reduce local unevenness. A display device may have local unevenness in a specific display area. For example, the unevenness may appear in a specific horizontal scanning line of a liquid crystal panel (hereinafter, this unevenness may be referred to as a streak) or may appear in a specific display element (hereinafter, this unevenness may be referred to as a dot). The local unevenness may appear in an area smaller than the above-described predetermined area. In such a case, even if the correction data common to the predetermined area is used to correct image data like the technology in Patent Document 1 , the local unevenness cannot be properly reduced. In order to properly reduce the local unevenness, it is effective to use a different correction data for each of the display elements to correct the image data. However, this increases the number of correction data to be stored in the memory. Accordingly, the memory capacity cannot be reduced.

DISCLOSURE OF THE PRESENT INVENTION

The present invention was accomplished in view of the above circumstances. It is an object of the present invention to provide a technology that can advantageously reduce unevenness and memory capacity.

Means for Solving the Problem

To solve the above problem, the present invention provides a method of driving a display panel having a display area including a first display area and a second display area. The method includes supplying an image data to each of the first display area and the second display area to display an image therein, and performing a first correction to correct only the image data supplied to the first display area in the image data supplying step. The first correction is performed based on a first correction data stored in a first memory.

In the method of driving a display panel, when the image data is supplied to each of the display areas to display the image in the display area, the image data for the first display area is corrected based on the first correction data, but the image data for the second display area is not corrected based on the first correction data. By correcting the image data for the first display area, the unevenness in the first display area can be reduced. Further, the first memory only have to have a capacity enough to store the first correction data that is required for the image data to be supplied to the first display area. The first memory does not need to have a capacity that is enough to store the correction data that is required for the image data supplied to the second display area. In other words, the capacity of the first memory can be reduced to the capacity enough to store the correction data required for the image data supplied to the first display area. According to the method of driving a display panel, the unevenness in the display panel and the memory capacity can be advantageously reduced.

Preferably, the first correction data includes a plurality of first correction data and the first display area includes a plurality of display elements. The plurality of first correction data and the plurality of display elements in the first display area may be equal in number. The image data for the first display area is subjected to a non-compressive correction, because the plurality of first correction data and the plurality of display elements in the first display area are equal in number. This properly reduces the unevenness in the first display area, compared with the case that the image data is subjected to a compressive correction. In the present invention, the first correction is performed only for the first display area, and thus, the memory capacity is not increased even if such a non-compressive correction is performed.

The first correction data is determined for each of reference gradation levels that are selected from displayable gradation levels. Generally, the correction required for the image data varies according to the gradation level. According to the present invention, the first image data is determined for each of the selected reference gradation levels, and thus, suitable correction for each gradation level can be performed. Further, the capacity of the first memory can be reduced compared with the case that the first correction data is determined for every displayable gradation level.

A second correction may be further performed. The second correction corrects the image data supplied to the display panel based on a second correction data stored in a second memory. Preferably, the second correction is performed after the first correction. The unevenness in the first display area is corrected in the first correction, and then the second correction is performed for the area including the first display area and the second display area. This can reduce the amount of correction required for the second correction compared with the case that only one correction is performed for the first display area and the second display area.

Preferably, the second correction data includes a plurality of second correction data and the display panel includes a plurality of display elements. The plurality of second correction data may be smaller than the plurality of display elements in the display panel in number. The image data for the display panel is subjected to compressive correction, because the number of second correction data is smaller than the number of display elements in the display panel. This reduces the capacity of the second memory compared with the case that the image data for the display panel is subjected to a non-compressive correction. The second correction is performed after the first correction. Accordingly, unevenness in the first display area has already been reduced by the first correction before the second correction. Thus, even if such a compressive correction is performed, the unevenness can be properly reduced.

Preferably, the first display area is set by every display area corresponding to one horizontal scanning line. If streaks occur, this configuration can properly reduce the streaks. Preferably, the first display area is set by every display area corresponding to one pixel. If dots occur, this configuration can properly reduce the dots.

Preferably, the display panel is a liquid crystal panel using liquid crystals. This can reduce the unevenness in the liquid crystal panel used in a large screen television and can advantageously reduce the memory capacity.

The present invention may be embodied as a driving circuit that performs the above-described method of driving a display panel. The driving circuit for a display panel according to the present invention is a driving circuit for the display panel having a display area including the first display area and the second display area different from the first display area. The driving circuit includes a supply circuit configured to supply an image data to each of the first display area and the second display area to display an image therein. The supply circuit includes a first correction circuit configured to correct only the image data supplied to the first display image area based on a first correction data and a first memory configured to store the first correction data. In such a driving circuit, the above-described driving method can be performed, and thus, the unevenness in the display panel and the memory capacity can be reduced.

The present invention may be embodied as a display device to be driven by the above driving method. The display device includes a display panel having a display area including a first display area and a second display area different from the first display area. The display device includes a supply circuit configured to supply an image data to each of the first display area and the second display area to display the image therein. The supply circuit includes a first correction circuit configured to only correct the image data supplied to the first display area and a first memory configured to store the image data for the first display area. In such a display device, the above-described driving method can be performed. Accordingly, the unevenness in the display panel can be reduced and deterioration of brightness and gradation characteristics can be advantageously suppressed.

Advantageous Effect of the Invention

According to the present invention, the unevenness and the memory capacity can be advantageously reduced.

MODE FOR CARRYING OUT THE INVENTION

<First Embodiment>

The first embodiment of the present invention will be described with reference to the drawings. The following embodiment will be described using a liquid crystal display device equipped with a liquid crystal panel as a display device. However, the technology according to the present invention is not only applicable to such a display device, but also applicable to an active matrix type display device such as PDP (Plasma Display Panel) display device and an organic EL (electro luminescence) display device, for example.

1 . Construction of the liquid crystal display device 10

The construction of the liquid crystal display device 10 will be explained with reference to FIG. 1.

Figure 1:
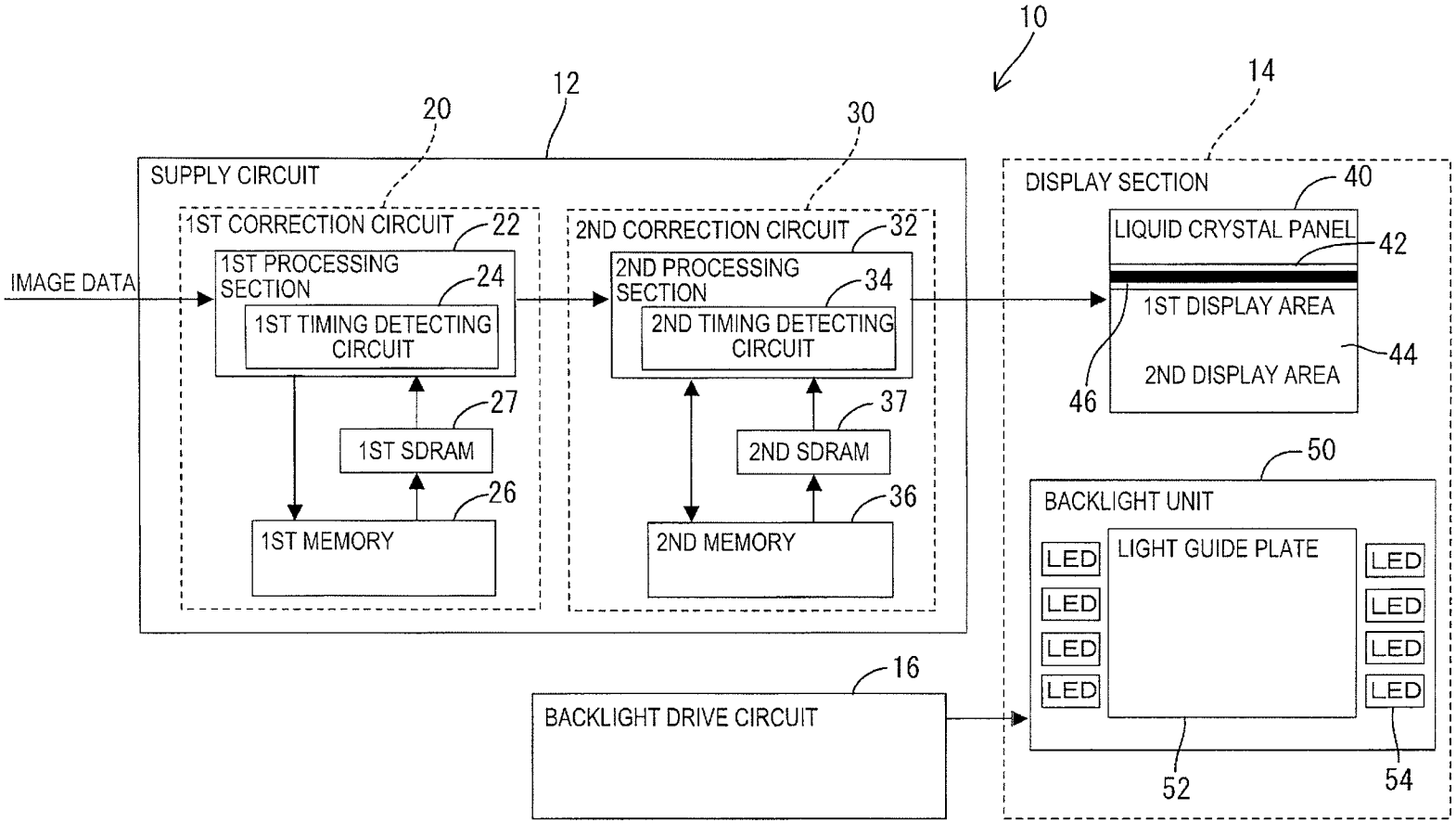
FIG. 1 is a view illustrating a configuration of a liquid crystal display device 10.

As illustrated in FIG. 1, the liquid crystal device 10 includes a supply circuit 12, a display section 14, and a backlight drive circuit 16. The display section 14 includes a liquid crystal panel 40 and a backlight unit 50.

The liquid crystal panel 40 includes a display area on which an image is displayed based on an image data. The display area of the liquid crystal panel 40 is divided into a first display area 42 and a second display area 44. The first display area 42 extends in a width direction of the display area over a group of horizontal scanning lines. The second display area 44 includes areas on an upper side and a lower side of the first display area 42. The term "divided" herein is used not only for the display area of the liquid crystal panel 40 that is physically separated, but also for the display area that is formally divided into sections by the image data supplied to the liquid crystal panel 40. The first display area 42 extends from one end to the other end of display area, i.e., over the entire width of the display area, over the group of horizontal scanning lines.

The backlight unit 50 is arranged behind the liquid crystal panel 40. The backlight unit 50 includes LEDs 54 (Light Emitting Diode) as light sources and a light guide plate 52.

The backlight drive circuit 16 is connected to the LEDs 54 included in the backlight unit 50. The backlight drive circuit 16 supplies current to each of the LEDs 54. By controlling the amount of current to be supplied to the LEDs 54, the amount of light to be entered into the light guide plate 52 from the LEDs 54 is controlled.

The supply circuit 12 supplies image data that is supplied from an external device (not illustrated) to each of the display areas 42, 44 of the liquid crystal panel 40. The image data includes a first image data 42A for the first display area 42 and a second image data 44A for the second display area 44. The supply circuit 12 supplies the first image data 42A to the first display area 42 to display an image in the first display area 42. The supply circuit 12 supplies the second image data 44A to the second display area 44 to display an image in the second display area 44.

The supply circuit 12 includes a first correction circuit 20 and a second correction circuit 30.

The first correction circuit 20 performs a first correction on the first image data 42A. The first correction circuit 20 includes a first processing section 22, a first memory 26, and a first SDRAM 27. The first processing section 22 includes a first timing detecting circuit 24 that measures time elapsed from the start of the image data supply. The input timing of the first image data 42A and the second image data 44A is determined in advance based on an arrangement of display elements provided in the display area of the liquid crystal panel 40. In the first correction circuit 20, the image data is divided into the first image data 42A and the second image data 44A based on the elapsed time measured with the first timing detecting circuit 24. Then, the first correction is performed only on the first image data 42A.

The first memory 26 stores a first correction data to be used in the first correction. The first correction is performed only on the first image data 42A. Accordingly, the capacity of the first memory 26 can be reduced to a size corresponding to the first image data 42A.

In the first correction circuit 20, when the first correction starts, the first timing detecting circuit 24 measures time elapsed from the start of the image data supply. Further, the first processing section 22 extracts the second image data 44A from the image data supplied by the external device. Furthermore, from the first memory 26, the first SDRAM 27 retrieves the first correction data that corresponds to the first image data 42A extracted by the first processing section 22. The first correction data is transferred between the first processing section 22 and the first SDRAM 27 to correct the first image data 42A. The first memory 26 is a non-volatile memory so as not to lose the first correction data even when the power of the supply circuit 12 is turned off. However, the non-volatile memory generally has a lower data transfer rate than a volatile memory such as SDRAM. The first correction circuit 20 employs the first SDRAM 27. A processing rate of the first correction is improved by transferring the correction data between the first processing section 22 and the first SDRAM 27.

The second correction circuit 30 performs the second correction on the first image data 42A and the second image data 44A. The second correction circuit 30 includes a second processing section 32, a second memory 36, and a second SDRAM 37. The second processing section 32 includes a second timing detecting circuit 34 that measures time elapsed from the start of the image data supply. The second memory 36 stores a second correction data to be used in the second correction.

In the second correction circuit 30, when the second correction starts, the second timing detecting circuit 34 measures time elapsed from the start of the image data supply. Further, the second processing section 32 receives the image data subjected to the first correction from the first correction circuit 20. Furthermore, from the second memory 36, the second SDRAM 37 retrieves the second correction data corresponding to the image data received by the second processing section 32. The second correction data is transferred between the second processing section 32 and the second SDRAM 37 to correct the first image data 42A and the second image data 44A. The processing rate of the second correction is also improved by the use of the second SDRAM 37.

2 . Determination processing of correction data and first display area

In the liquid crystal display device 10, a determination processing for determining the correction data and the first display area 42 is performed before use. Generally, the correction data and the first display area 42 should be determined for every liquid crystal display device 10 in view of factors specific to the liquid crystal panel 40 and the backlight unit 50 of each liquid crystal display device 10. However, if the liquid crystal panels 40 and the backlight units are manufactured on the same assembly line for mass production, the cause of the unevenness may be the same. In such a case, the determination processing is performed in advance to determine the correction data and the first display area 42 for a plurality of liquid crystal devices 10. This facilitates the determination processing in the liquid crystal display devices 10.

Figure 2:
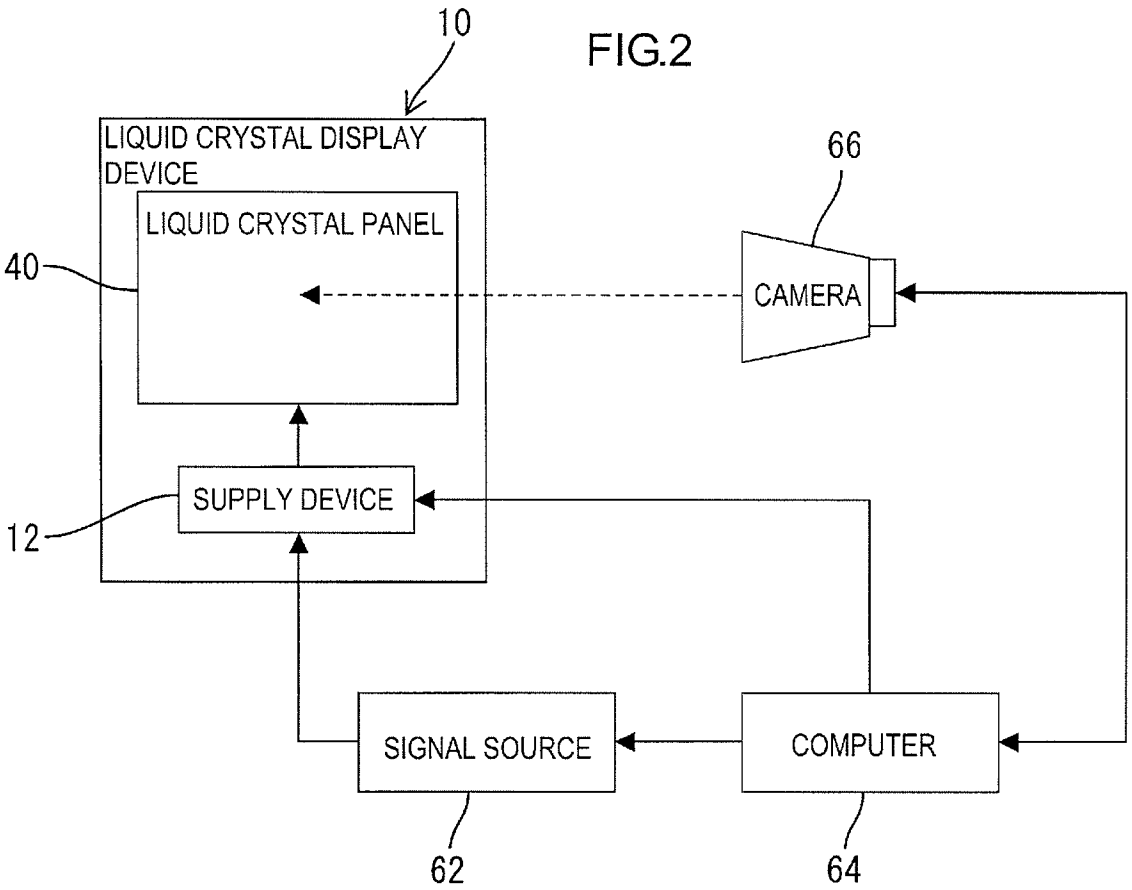
FIG. 2 is a view illustrating how correction data and a first display area 42 are determined.

The liquid crystal display device 10 is connected as illustrated in FIG. 2 to perform the above determination processing. The liquid crystal display device 10 is connected to a signal source 62. The signal source 62 supplies image data to display an image in the display area of the liquid crystal panel 40. A camera 66 is arranged on the front of the liquid crystal panel 40. The liquid crystal panel 40 is captured with the camera 66. The signal source 62 and the camera 66 are connected to a computer 64 to perform a specific operation by instructions from the computer 64. The computer 64 is connected to the supply circuit 12 of the liquid crystal display device 10, and thus, the first memory 26 and the second memory 36 stores the information relating to the correction data and the first display area 42 determined by the determination processing.

Figure 3:
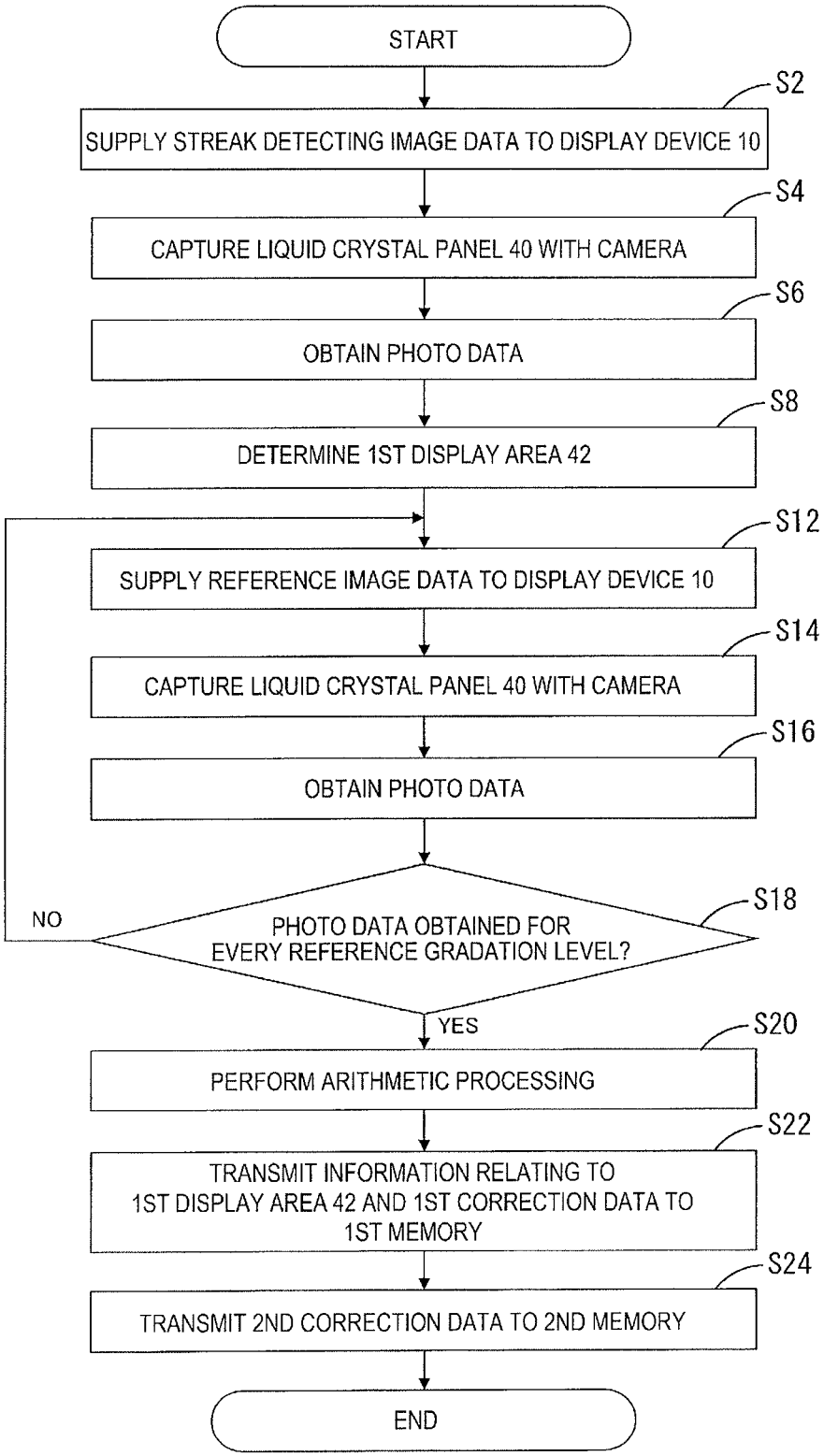
FIG. 3 is a flow diagram of a determination processing.

The determination processing will be explained with reference to FIG. 3.

At the start of the determination processing, the computer 64 supplies an image data for detecting a streak from the signal source 62 to the liquid crystal display device 10 (step S2). Then, the computer 64 controls the camera 66 to capture the liquid crystal panel 40 (step S4), and then obtains photographic data (step S6). In the determination processing, the correction data and the first display area 42 are not determined, and thus the first correction and the second correction are not performed on a reference image data.

The image data for detecting a streak includes a detecting mark on a specific horizontal scanning line in a solid pattern having a white gradation level. The computer 64 extracts a brightness value from the obtained photographic data and uses the brightness value to determine whether the streak 46 has appeared on the specific horizontal scanning line. The signal source 62 includes a plurality of image data for detecting a streak. Each of the plurality of image data for detecting a streak includes a detecting mark on each of the horizontal scanning lines in the liquid crystal panel 40, and each of the horizontal lines functions as the specific horizontal scanning line. The computer 64 controls the camera 66 to obtain the photographic data of each of the plurality of image data for detecting a streak.

Next, the computer 64 specifies a horizontal scanning line on which the streak 46 appears. The computer 64 determines the display area including such a horizontal scanning line with the streak 46 as the first display area 42 (step S8). If the streak 46 appears on a plurality of regions of the liquid display panel 40, the regions are collectively determined as the first display area 42.

Next, the computer 64 supplies the image data from the signal source 62 to the liquid crystal display device 10. The image data (hereinafter may be referred to as a reference image data) have a reference gradation level and is in solid pattern. In the computer 64, reference gradation levels are selected from gradation levels displayable on the liquid crystal panel 40 in advance. The reference image data for each reference gradation level is stored in the signal source 62 in advance.

Next, the computer 64 controls the camera 66 to capture the liquid crystal panel 40 (step S14), and then obtains photographic data from the camera 66 (step S16). The computer 64 determines whether the photographic data have been obtained for each reference gradation level (step S18). If the photographic data have not been obtained for each reference gradation level (NO in S18), the step S12 and the step S16 are repeated. If the photographic data have been obtained for each reference gradation level (YES in S18), an arithmetic processing is performed (step S20).

Figure 4:
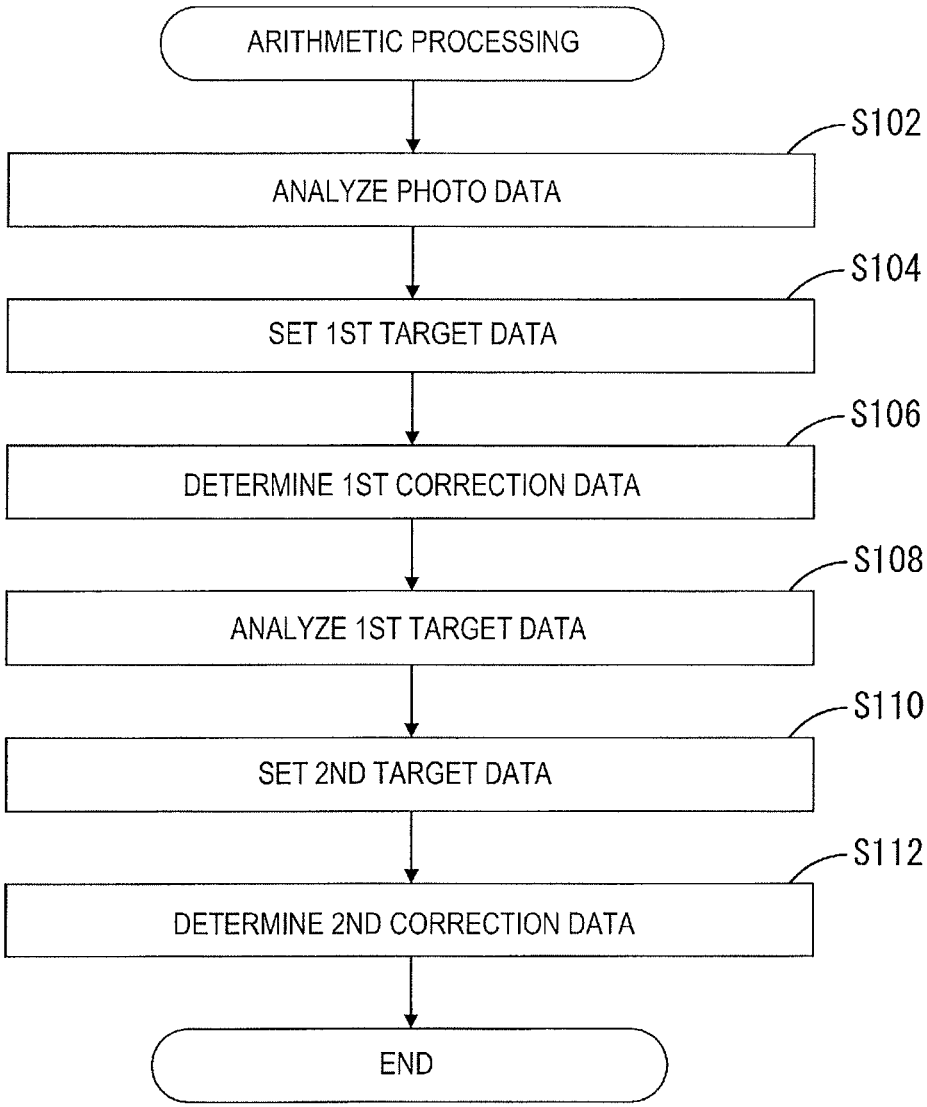
FIG. 4 is a flow diagram of an arithmetic processing.

As illustrated in FIG. 4, in the arithmetic processing, the computer 64 extracts brightness value from the photographic data. Then, the computer 64 analyzes the characteristics of the photographic data (step S102) and sets a first target data (step S104). The first target data is the same as the reference image data in the second display area 44 and is different from the reference image data in the first display area 42. The computer 64 sets the first target value in the first display area 42 with reference to the following characteristics of the liquid crystal panel 40, for example: (1) the area where the streak 46 appears; and (2) the degree of decrease (or increase) in brightness in the area where the streak 46 appears.

Next, the computer 64 determines the first correction data (step S106). Specifically, a correction data is calculated such that the reference image data in the first display are 42 is corrected to the first target data in the first display area 42. This correction data is determined as the first correction data. In the present embodiment, even when the streak 46 appears on the liquid crystal panel 40, the reference image data is corrected to the first target data based on the first correction data. As a result, the streak 46 can be properly reduced.

In the arithmetic processing, the first target data is set for each of the reference gradation levels selected by the computer 64, and the first correction data is also determined. Generally, the correction required for the image data varies according to the gradation level. The first correction data is set for each of the selected reference gradation levels, and thus the correction suitable for each gradation level can be performed. Ina gradation level between the reference gradation levels, correction suitable for the gradation level can be performed by linearly interpolating two reference gradation levels close to the gradation level.

Next, the computer 64 analyzes the first target data (step S108) and sets the second target data (step S110). Even if the first target data subjected to the first correction does not include the unevenness such as a streak in which the brightness value locally decreases (or increase), the brightness value may have long-period unevenness in which the brightness value slightly increase and decrease over a wide range, for example. The computer 64 analyzes the first target data and sets the second target data if the long-period unevenness is detected. The second target data in the first display area 42 and the second target data in the second display area 44 are not necessarily the same. The second target data maybe separately set for the first display area 42 and the second display area 44.

Next, the computer 64 determines the second correction data (step S112). Specifically, a correction data is calculated such that the first target data is corrected to the second target data. The correction data is determined as the second correction data. This is the end of the arithmetic processing of the computer 64.

In the arithmetic processing, the second target data is set for each of the reference gradation levels selected by the computer 64, and the second correction data is also determined. The second correction data is set for each of the selected reference gradation levels, and thus the correction suitable for each gradation level can be performed.

Next, the computer 64 transmits the information relating to the first display area 42 and the first correction data to the first memory 26 (step S22), so that the first memory 26 stores the transmitted information. Further, the computer 64 transmits the second correction data to the second memory 36 (step S24), so that the second memory 36 stores the second correction data. This is the end of the determination processing of the computer 64.

3 . Operation of the supply circuit 12

When the external device starts supplying the image data during the use of the liquid crystal display device 10, the timing detecting circuits 24, 34 in the supply circuit 12 measures the time elapsed from the start of the image data supply. Then, the first correction circuit 20 performs the first correction on the first image data 42A included in the supplied image data. Then, the second correction circuit 30 performs the second correction on the image data corrected by the first correction circuit 20. The supply circuit 12 supplies the image data corrected by the first correction circuit 20 and the second correction circuit 30 to the liquid crystal panel 40, and thus an image is displayed on the liquid crystal panel 40. As a result, the liquid crystal display device 10 operates.

More specifically described, the first correction circuit 20 in the supply circuit 12 performs the first correction on the supplied image data at first. In the first correction, the first correction circuit 20 performs the first correction on the first image data 42A of the supplied image data and does not perform the correction on the second image data 44A. The correction on the first image data 42A can reduce the unevenness such as a streak in the first display area 42. Further, the first memory 26 is necessary to store only the correction data for the first display data 42A, and thus the capacity of the first memory 26 can be advantageously reduced.

In the supply circuit 12, the second correction is performed on the supplied image data by the second correction circuit 30 after the first correction is performed on the supplied image data by the first correction circuit 20. Generally, the local unevenness such as a streak is likely to require more correction than the long-period unevenness that appears over a wide range. The second correction is performed on the area including the first display area 42 and the second display area 44 after the first correction is performed to correct the unevenness in the first display area 42. Accordingly, the correction required for the second correction can be reduced. This can suppress the deterioration of brightness and gradation characteristics of the entire liquid crystal panel 40.

4 . Characteristics of the first correction and the second correction

In the supply circuit 12 of the present embodiment, the non-compressive correction is performed on the first image data 42A in the first correction and the compressive correction is performed on the first image data 42A and the second image data 44A in the second correction.

(Characteristics of the First Correction)

Figure 5:
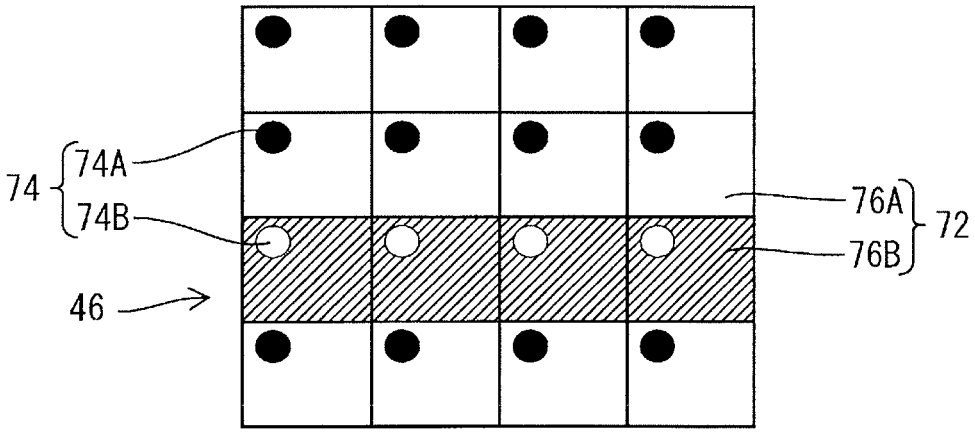
FIG. 5 is a view illustrating a first correction in which a non-compressive correction is performed.

As illustrated in FIG. 5, in the non-compressive correction, an independent correction data 74 is provided for each of the display elements 72. Specifically, even if the streak 46 appears in the area for the first correction (the first display area 42) as indicated in shaded portions in FIG. 5, the display elements 76B including the streak 46 are corrected based on the first correction data 74B and the display elements 76A without the streak 46 are each corrected based on the second correction data 74A. Accordingly, correction is performed properly for each of the display area 72 and this reduces the streaks 46. The area for the first correction is limited to the area including the streak 46. Therefore, although the first correction is non-compressive correction, the number of first correction data and the capacity of the first memory 26 are less likely to increase.

(Characteristics of the Second Correction)

Figure 6:
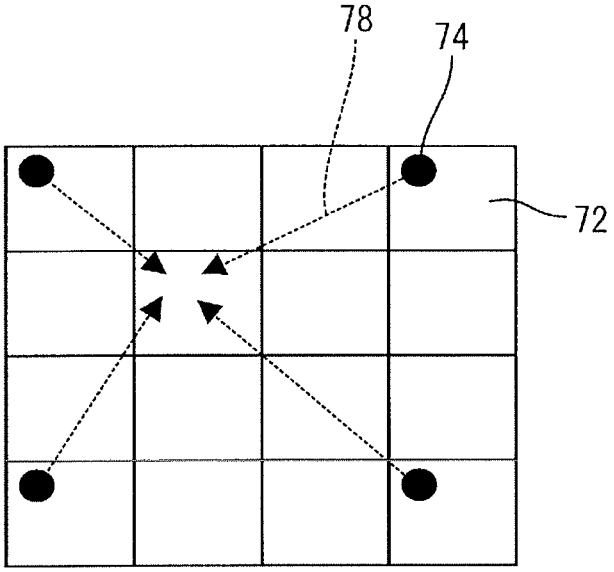
FIG. 6 is a view illustrating a first correction in which a compressive correction is performed.

As illustrated in FIG. 6, in the compressive correction, the correction data is provided for only the selected display elements 72. A display element 72 that is present between the selected display elements 72 is corrected based on each correction data provided for each of the selected display elements 72 (see broken lines 78). The compressive correction requires smaller number of correction data than the non-compressive correction. The number of the second correction data required for the second correction can be made smaller by employing the compressive correction rather than the non-compressive correction. Accordingly, the capacity of the second memory 36 can be advantageously reduced.

<Second Embodiment>

Figure 7:
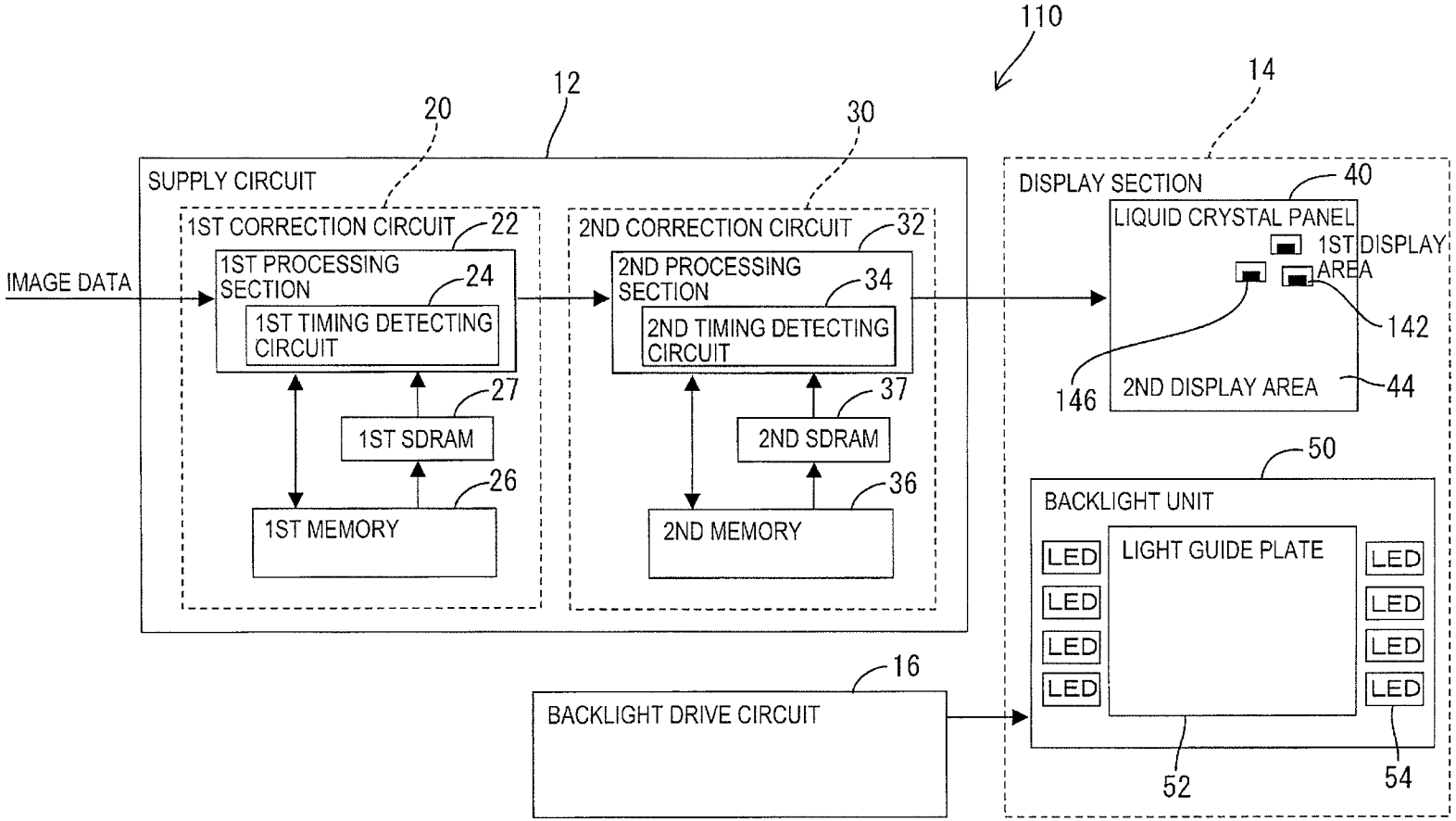
FIG. 7 is a view illustrating a configuration of a liquid crystal display device 110.

A liquid crystal display device 110 according to the second embodiment of the present invention is illustrated in FIG. 7. The liquid crystal display device 110 includes a first display area 142 with dots 146. In this point, the liquid crystal display device 110 differs from the liquid crystal device 10 of the first embodiment with the streak 46.

According to the present embodiment, the liquid crystal panel 40 is used to determine the first display area 142 and the first correction data, and then, the correction is performed based on the determined first correction data. Thus, when the dots 146 appear on the liquid crystal panel 40 as the present embodiment, the dots 146 can be properly reduced.

<Other Embodiments>

The present invention is not limited to the above embodiments described in the above description and the drawings. The following embodiments are also included in the technical scope of the present invention, for example.

(1) In the above embodiment, the unevenness caused by the liquid crystal panel 40 is exemplified as the local unevenness such as a streak and a dot. However, the present invention is not limited thereto. The present invention is applicable to the unevenness caused by the backlight unit 50. The unevenness may be caused by difference in the amount of light emitted from the LEDs 40 as light sources.

(2) In the above embodiments, the correction data and the first display area 42 are determined based on the brightness value extracted from the photographic data of the liquid crystal panel 40. However, the present invention is not limited to this. A chromaticity value may be extracted from the photographic data and used to determine the correction data and the first display area 42. Alternatively, both of the brightness value and the chromaticity value may be used.

(3) In the above embodiments, the first correction circuit 20 and the second correction circuit 30 are described as separate circuits. However, the first correction circuit 20 and the second correction circuit 30 maybe one circuit that performs two corrections, like a timing controller (T-CON). Further, the first timing detecting circuit 24 and the second detecting circuit 34 may be one timing detecting circuit. The same may be applied to the first memory 26 and the second memory 36, and the first SDRAM 27 and the Second SDRAM 37.

(4) In the above embodiments, the first correction and the second correction are independently effective. Only one of them may be performed. For example, when the streak occurs without the long-period unevenness, only the first correction should be performed. When the long-period unevenness occurs without the streak, only the second correction should be performed.

(5) In the above embodiments, the LED is used as a light source. A light source other than the LED may be used.

Explanation of Symbols

10: display device, 12: supply circuit, 14: display section, 16: backlight drive circuit, 20: first correction circuit, 30: second correction circuit, 40: liquid crystal panel, 42: first display area, 44: second display area, 46: streak, 50: backlight unit, 62: signal source, 64: computer, 66: camera, 72: display element, 74: correction data, 146: dot

The invention claimed is:

1. A display device driving circuit for supplying image data to a display device, the display device driving circuit comprising:

a first memory configured to store first correction data for correction of at least one piece of the image data;

a first processing circuit configured to receive the image data from an external device;

extract, from the received image data, first image data for a first display area of the display device and second image data for a second display area of the display device; and correct the first image data using the first correction data;

a second memory configured to store second correction data for correction of at least one piece of the image data and the first image data corrected by the first processing circuit; and a second processing circuit configured to receive the first image data corrected by the first processing circuit from the first processing circuit;

receive the second image data from the first processing circuit;

correct the first image data corrected by the first processing circuit and the second image data using the second correction data;

supply the first image data corrected by the first processing circuit and the second processing circuit to the first display area of the display device; and supply the second image data corrected by the second processing circuit to the second display area of the display device.

2. The display device driving circuit according to claim 1, wherein a number of data pieces of the first correction data is equal to a number of display elements of the display device.

3. The display device driving circuit according to claim 1, wherein the first correction data includes data pieces for reference gradation levels selected from displayable gradation levels, and each of the data pieces of the first correction data is defined for a corresponding reference gradation level among the reference gradation levels.

4. The display device driving circuit according to claim 1, wherein a number of data pieces of the second correction data includes is smaller than a number of display elements of the display device.

5. The display device driving circuit according to claim 1, wherein the first processing circuit includes a timing detecting circuit configured to measure time elapsed from a start of supply of the image data from the external device, and the first processing circuit is configured to divide the image data into the first image data and the second image data based on the time measured by the timing detecting circuit.

6. The display device driving circuit according to claim 1, further comprising:

a first volatile memory configured to store the first correction data extracted from the first memory; and a second volatile memory configured to store the second correction data extracted from the second memory, wherein the first memory and the second memory are nonvolatile memories, the first processing circuit is configured to transfer the first correction data between the first memory and the first volatile memory, and the second processing circuit is configured to transfer the second correction data between the second memory and the second volatile memory.

7. The display device driving circuit according to claim 1, wherein the first correction data includes data pieces for a plurality of display elements of the display device, the second correction data includes data pieces for selected display elements among the plurality of display elements of the display device, the first processing circuit is configured to correct data pieces of the first image data using the respective data pieces of the first correction data, the second processing circuit is configured to correct the data pieces of the first image data corrected by the first processing circuit and data pieces of the second image data for the selected display elements using the respective data pieces of the second correction data, for each of the display elements other than the selected display elements, the second processing circuit is configured to correct the data piece of the first image data corrected by the first processing circuit using the data pieces of the second correction data for the selected display elements, and for each of the display elements other than the selected display elements, the second processing circuit is configured to correct the data piece of the second image data using the data pieces of the second correction data for the selected display elements.

8. A display device, comprising:

a display panel including a first display area and a second display area, a display device driving circuit configured to supply image data to the first display area and the second display area, the display device driving circuit including:

a first memory configured to store first correction data for correction of at least one piece of the image data;

a first processing circuit configured to receive the image data from an external device;

extract, from the received image data, first image data for the first display area and second image data for the second display area; and correct the first image data using the first correction data;

a second memory configured to store second correction data for correction of at least one piece of the image data and the first image data corrected by the first processing circuit; and a second processing circuit configured to receive the first image data corrected by the first processing circuit from the first processing circuit;

receive the second image data from the first processing circuit;

correct the first image data corrected by the first processing circuit and the second image data using the second correction data;

supply the first image data corrected by the first processing circuit and the second processing circuit to the first display area of the display device; and supply the second image data corrected by the second processing circuit to the second display area of the display device.

9. The display device according to claim 8, wherein the first display area includes a display defect severer than a display defect in the second display area.

10. The display device according to claim 8, wherein a number of data pieces of the first correction data is equal to a number of display elements of the display device.

11. The display device according to claim 8, wherein the first correction data includes data pieces for reference gradation levels selected from displayable gradation levels, and each of the data pieces of the first correction data is defined for a corresponding reference gradation level among the reference gradation levels.

12. The display device according to claim 8, wherein a number of data pieces of the second correction data is smaller than a number of display elements of the display device.

13. The display device according to claim 8, wherein the first processing circuit includes a timing detecting circuit configured to measure time elapsed from a start of supply of the image data from the external device, and the first processing circuit is configured to divide the image data into the first image data and the second image data based on the time measured by the timing detecting circuit.

14. The display device according to claim 8, further comprising:

a first volatile memory configured to store the first correction data extracted from the first memory; and a second volatile memory configured to store the second correction data extracted from the second memory, wherein the first memory and the second memory are nonvolatile memories, the first processing circuit is configured to transfer the first correction data between the first memory and the first volatile memory, and the second processing circuit is configured to transfer the second correction data between the second memory and the second volatile memory.

15. The display device according to claim 8, wherein the first correction data includes data pieces for a plurality of display elements of the display device, the second correction data includes data pieces for selected display elements among the plurality of display elements of the display device, the first processing circuit is configured to correct the data pieces of the first image data using the respective data pieces of the first correction data, the second processing circuit is configured to correct the data pieces of the first image data corrected by the first processing circuit and the data pieces of the second image data for the selected display elements using the respective data pieces of the second correction data, for each of the display elements other than the selected display elements, the second processing circuit is configured to correct the data piece of the first image data corrected by the first processing circuit using the data pieces of the second correction data for the selected display elements, and for each of the display elements other than the selected display elements, the second processing circuit is configured to correct the data piece of the second image data using the data pieces of the second correction data for the selected display elements.

16. The display device according to claim 8, wherein the first display area corresponds to a horizontal scanning line.

17. The display device according to claim 8, wherein the first display area corresponds to a pixel.

18. A method for driving the display device according to claim 8, the method comprising:

capturing a first image of the display device;

obtaining first data related to the first image of the display device;

specifying a scanning line on which a defect appears;

determining a display area including the scanning line as the first display area;

determining a display area other than the first display area as the second display area;

supplying reference image data from a signal source to the display device; capturing a second image of the display device;

obtaining second data related to the second image of the display device;

determining first target data based on the second data;

calculating the first correction data based on the first target data;

determining second target data based on the first target data;

calculating the second correction data based on the first target data and the second target data;

obtaining the first image data for the first display area;

correcting the first image data using the first correction data;

obtaining the second image data for the second display area;

correcting (i) the corrected first image data using the first correction data and (ii) the second image data using the second correction data;

supplying the corrected first image data using the first correction data and the second correction data to the first display area; and supplying the corrected second image data using the second correction data to the second display area.

* * * * *